US008474688B2

(12) United States Patent
Cameron

(10) Patent No.: US 8,474,688 B2
(45) Date of Patent: Jul. 2, 2013

(54) BOX WITH REMOVABLE TOP

(75) Inventor: Hugh T. Cameron, Oakville (CA)

(73) Assignee: Retail Ready Package Inc., Calgary, Alberta (CA)

( * ) Notice: Subject to any disclaimer, the term of this patent is extended or adjusted under 35 U.S.C. 154(b) by 565 days.

(21) Appl. No.: 12/662,137

(22) Filed: Mar. 31, 2010

(65) Prior Publication Data

US 2011/0240727 A1 Oct. 6, 2011

(51) Int. Cl.
*B65D 17/28* (2006.01)

(52) U.S. Cl.
USPC ..... 229/240; 229/162.1; 229/242

(58) Field of Classification Search
USPC ..... 229/120.011, 103.2, 162.1, 240, 229/242, 191, 192, 915, 918; 206/736, 769
See application file for complete search history.

(56) References Cited

U.S. PATENT DOCUMENTS

| | | | | |
|---|---|---|---|---|
| 3,162,351 | A * | 12/1964 | Rudofski | 229/191 |
| 3,361,326 | A * | 1/1968 | Croley et al. | 229/192 |
| 3,777,969 | A | 12/1973 | Nurre | |
| 4,201,291 | A | 5/1980 | Davidson | |
| 4,815,609 | A * | 3/1989 | Kiedaisch | 229/240 |
| 4,871,067 | A * | 10/1989 | Valenti | 229/164 |
| 5,657,872 | A | 8/1997 | Leftwich et al. | |
| 6,129,211 | A | 10/2000 | Prakken et al. | |
| 6,168,027 | B1 | 1/2001 | Esser | |
| 6,386,368 | B1 | 5/2002 | Pirro | |
| 6,478,159 | B1 | 11/2002 | Taylor et al. | |
| 6,755,306 | B2 * | 6/2004 | Maus | 229/120.011 |
| 7,000,824 | B2 * | 2/2006 | Saulas | 229/191 |
| 7,021,468 | B2 | 4/2006 | Cargile, Jr. | |
| 7,080,736 | B2 | 7/2006 | Jackson et al. | |
| 7,150,903 | B2 | 12/2006 | Frey | |
| 7,451,878 | B2 | 11/2008 | Rochefort et al. | |
| 7,549,542 | B2 | 6/2009 | Gasior et al. | |
| 7,988,034 | B2 * | 8/2011 | Pezzoli | 229/242 |
| 2005/0045706 | A1 * | 3/2005 | Varanasi | 229/240 |
| 2005/0184139 | A1 * | 8/2005 | Gasior | 229/240 |
| 2008/0237070 | A1 | 10/2008 | Justice | |
| 2009/0282843 | A1 | 11/2009 | Brand | |

FOREIGN PATENT DOCUMENTS

| | | | | |
|---|---|---|---|---|
| EP | 0706948 | A1 | 4/1996 | |
| JP | 1-254541 | A * | 10/1989 | 229/198.2 |
| WO | 01/87721 | A1 | 11/2001 | |

OTHER PUBLICATIONS

Jervelund, European Patent Office, "Extended European Search Report", dated Jul. 6, 2011, in related European Application No. 11160205.8.

European Patent Office, Office Communication dated Nov. 5, 2012, in related European Application No. 11160205.8.

* cited by examiner

*Primary Examiner* — Gary Elkins

(57) ABSTRACT

A box blank comprises serially attached top, bottom, first side, and second side panels, each having two side edges, with a side flap attached to each side edge. A first tear line extends across the top panel and side flaps attached thereto. A second tear line extends across the top or first side panel, and side flaps attached thereto. The panels and flaps are foldable to form a box with bottom formed from the bottom panel, top formed from the top panel, first side formed from the first side panel, second side formed from the second side panel, third and fourth sides formed from the side flaps. The side flaps are sized so that the third and fourth sides are partially open. The tear lines are positioned so that a top portion of the box is removable by separating it along the tear lines.

24 Claims, 11 Drawing Sheets

230
220
210
240

230
226
228
220
227
228
210
246
248
240
247
248

230
220
210
240

250
238
230
239
240
220
210

260
216
210
220
240
217

BOX WITH REMOVABLE TOP

FIELD OF THE INVENTION

The present invention relates to boxes and blanks for boxes.

BACKGROUND OF THE INVENTION

Many goods and products are shipped and stored in shipping containers, such as cardboard or paperboard boxes. In many cases, such as in a retail store, it is desirable to store or display certain goods and products on shelves so that the goods and products are conveniently visible and accessible by a user. Thus, some shipping containers have been designed to be convertible from a shipping configuration to a display configuration. For example, U.S. Pat. No. 7,451,878 to Rochefort et al., issued Nov. 18, 2008, discloses shipping containers that are convertible to display containers. A container disclosed in U.S. Pat. No. 7,451,878 is formed of an outer wrap portion and an internal divider/structural support portion. Openings are provided in the face panel of the container. Zipper pull tabs are also provided in the side face panels so that the face panel and the top half of the outer wrap portion may be removed to convert the container into a dispensing container or a tray. The blank for forming the outer wrap portion has an irregular shape, with a width varying substantially along its length. Another shipping/display container is disclosed in U.S. Pat. No. 5,657,872 to Leftwich et al., issued Aug. 19, 1997. The disclosed container has a tray portion and a cover portion. The front side panel of the tray portion has a severable portion, which may be removed to allow products be extracted from the resulting opening. U.S. Pat. No. 6,168,027 to Esser, issued Jan. 2, 2001, discloses a shipping/display box having a tear-out segment spaced from all eight corners of the box. The tear-out segment can be removed at a store for display.

However, improvements to existing shipping/display containers are desirable.

SUMMARY OF THE INVENTION

In accordance with an aspect of the present invention, there is provided a box blank that comprises a top panel, a bottom panel, a first side panel, and a second side panel. The panels are serially attached to one another and each of the panels has two side edges. A side flap is attached to each side edge of each panel. A first tear line extends across the top panel and side flaps attached to the top panel. A second tear line extends across the top or first side panel and across side flaps attached to the top or first side panel. The panels and flaps are foldable to form a box that comprises a bottom formed from the bottom panel, a top formed from the top panel, a first side formed from the first side panel, a second side formed from the second side panel, third and fourth sides each formed from side flaps each extending from one of the panels. The side flaps are sized so that the third and fourth sides of the box are partially open. The first and second tear lines are positioned so that the top and the first, third and fourth sides of the box are each at least partially removable by separating them along the first and second tear lines. The first and second tear lines may be substantially parallel. Two of the panels may be end panels each having an end edge. The blank may further comprise an end flap attached to the end edge of at least one of the end panels, where the end flap may be foldable along the end edge. An end flap may be attached to each end panel. The first tear line may be substantially perpendicular to the side edges of the top panel and may be positioned so that a portion of the first tear line is adjacent a terminal edge of the side flaps attached to the second side panel in the box. A fold line may be provided between each pair of the panels and flaps that are attached to each other. The first and second tear lines may be substantially parallel to a fold line between the top panel and a side panel adjacent to the top panel. A fold line may be provided on each one of the side flaps attached to one of the side panels, such that the side flap is foldable along the fold line on the side flap to form a reinforced edge in the box. Two fold lines may be provided on each side flap, such that each side flap is foldable to form a triangular prism shaped reinforced edge in the box. At least one of the first and second tear lines may be substantially straight. The blank may comprise a material selected from cardboard, paper, and plastic. At least one of the first and second tear lines may be provided by a line of perforation or a tear strip. The blank may have a substantially rectangular shape.

In another aspect of the present invention, there is provided a box. The box comprises a bottom; a top; first and second sides opposite one another; third and fourth sides opposite one another, each being partially open and comprising a top flap and a bottom flap separated from the top flap, the top flap attached to the top of the box; a first tear line extending across the top and the top flaps; and a second tear line extending across the top and the top flaps, or extending across one of the first and second sides. The first and second tear lines are positioned so that the top, the one of the first and second sides, and the top flaps are each at least partially removable by separating them along the first and second tear lines. The first and second tear lines may be substantially parallel. The first and second tear lines may be substantially parallel to an edge between the top and one of the first and second sides. At least one edge between two adjacent sides may be reinforced. The reinforced edge may comprise a folded flap. A folded flap may be folded along one fold line to form a double-layered support. A folded flap may be folded along two parallel fold lines to form a substantially triangular prism support. At least one of the first and second tear lines may be provided by a line of perforation. At least one of the first and second tear lines may be provided by a tear strip.

In accordance with a further aspect of the present invention, there is provided a display box, which comprises a box described in the preceding paragraph, where the top, one of the first and second sides, and the top flaps have each been at least partially removed along the first and second tear lines.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1A:
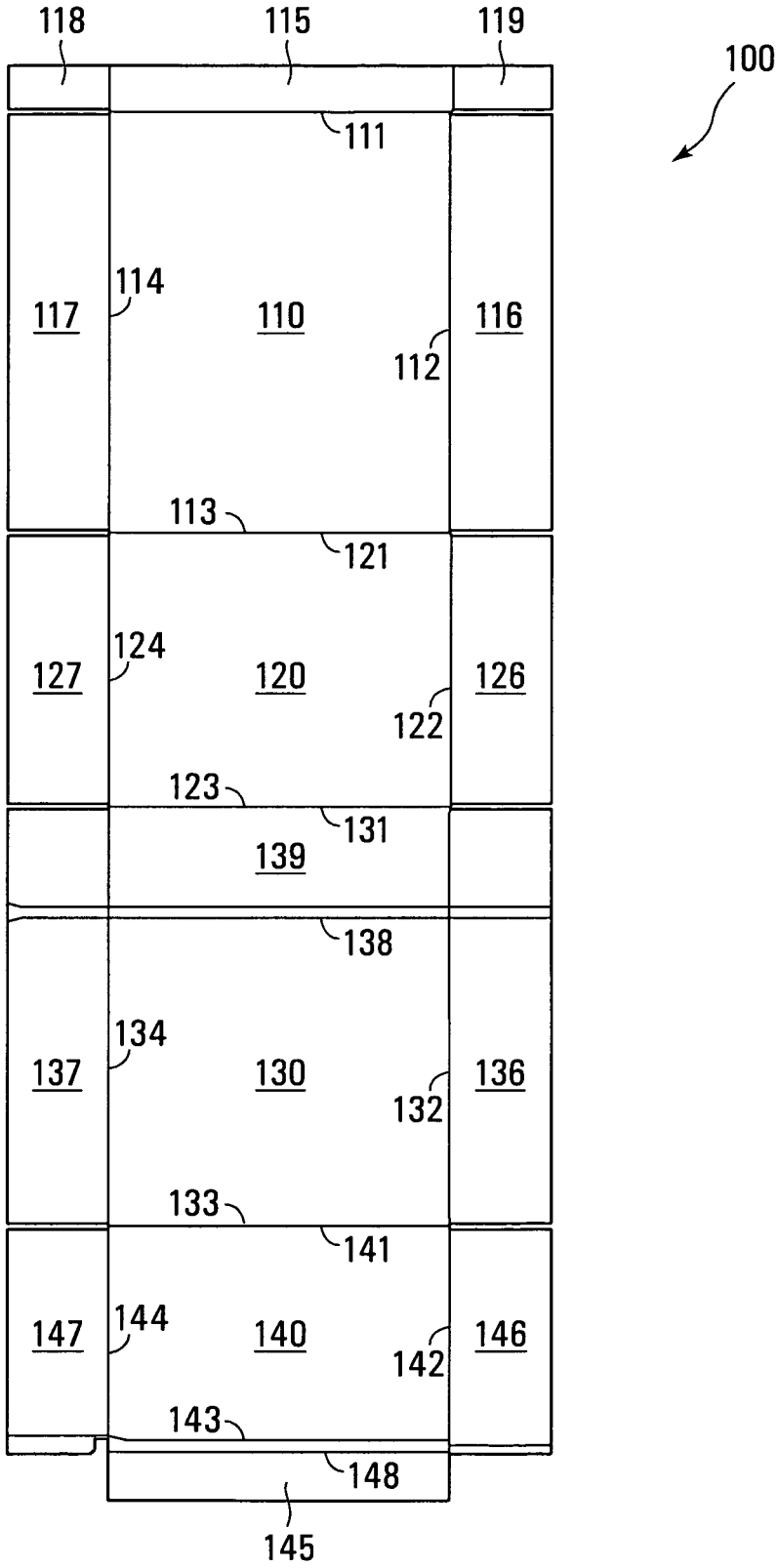
FIG. 1A is a plan view of a blank for a box, exemplary of an embodiment of the present invention.

FIG. 1A depicts a box blank 100, exemplary of an embodiment of the present invention.

Blank 100 includes serially attached bottom panel 110, back side panel 120, top panel 130, and front side panel 140.

Bottom panel 110 has end edge 111, side edge 112, end edge 113 and side edge 114. An end flap 115 is attached to end edge 111. A fold line is provided at the joint of bottom panel 110 and end flap 115 along end edge 111. A side flap 116 is attached to bottom panel 110 along side edge 112, and a side flap 117 is attached to bottom panel 110 along side edge 114.

Side panel 120 has end edge 121, side edge 122, end edge 123 and side edge 124. A side flap 126 is attached to side panel 120 along side edge 122, and a side flap 127 is attached to side panel 120 along side edge 124.

Bottom panel 110 and side panel 120 are attached to each other along end edges 113 and 121.

Top panel 130 has end edge 131, side edge 132, end edge 133 and side edge 134. A side flap 136 is attached to top panel 130 along side edge 132, and a side flap 137 is attached to top panel 130 along side edge 134. A tear line is provided by way of a tear strip 138 across top panel 130 and side flaps 136 and 137. As depicted, tear strip 138 may be substantially parallel to end edges 131 and 133, and substantially perpendicular to side edges 132 and 134. Tear strip 138 may be located in proximity to end edge 131 so that a portion 139 of top panel 130 is between end edge 131 and tear strip 138, as depicted. However, the distance between end edge 131 and tear strip 138 may vary in different embodiments.

Side panel 120 and top panel 130 are attached to each other along end edges 123 and 131.

Side panel 140 has end edge 141, side edge 142, end edge 143 and side edge 144. An end flap 145 is attached to end edge 143. A side flap 146 is attached to side panel 140 along side edge 142, and a side flap 147 is attached to side panel 140 along side edge 144. A tear line is provided by way of a tear strip 148 across side panel 140 and, optionally, across side flaps 146 and 147. As depicted, tear strip 148 may be substantially parallel to end edges 143, and substantially perpendicular to side edges 142 and 144. Tear strip 148 may be located near or at end edge 143, as depicted, but the distance between end edge 143 and tear strip 148 may vary in different embodiments.

In a different embodiment, one or both of tear strips 138, 148 may be partially or entirely replaced with a line of perforation or score line to provide the desired tear line(s). Tear lines may also be provided with another form of weakened line or portion. For example, any suitable tear line construction known to those skilled in the art may be used.

Top panel 130 and side panel 140 are attached to each other along end edges 133 and 141.

A fold line is provided at the joint between each pair of attached panels 110, 120, 130, 140 and flaps 115, 116, 117, 118, 119, 126, 127, 136, 137, 145, 146, 147, so that the panels and flaps are foldable along the fold lines to form a box.

Blank 100 may be formed of any suitable material for box blanks and packaging boxes. For example, cardboard, paper board, fibreboard, or plastics may be used. Suitable material may include double faced corrugated cardboard. Other materials typically used for forming shipping or packaging boxes may be used.

Glues or other adhesive materials or suitable configurations for attaching or fixing different parts of blank 100 may be additionally provided at the appropriate locations on blank 100, if desired.

Blank 100 may have any suitable thickness and size. Blank 100 may have a substantially uniform thickness. In some embodiments, blank 100 may have a thickness from about 1 mm to about 5 mm. In a particular embodiment, blank 100 may have a thickness of about 3 or about 4 mm.

Blank 100 may be folded into a box 150, as illustrated in FIGS. 1B, 1C, 1D, 1E, and 1F, according to an exemplary embodiment.

Figures 1B, 1C, 1D, 1E, 1F, 1G:
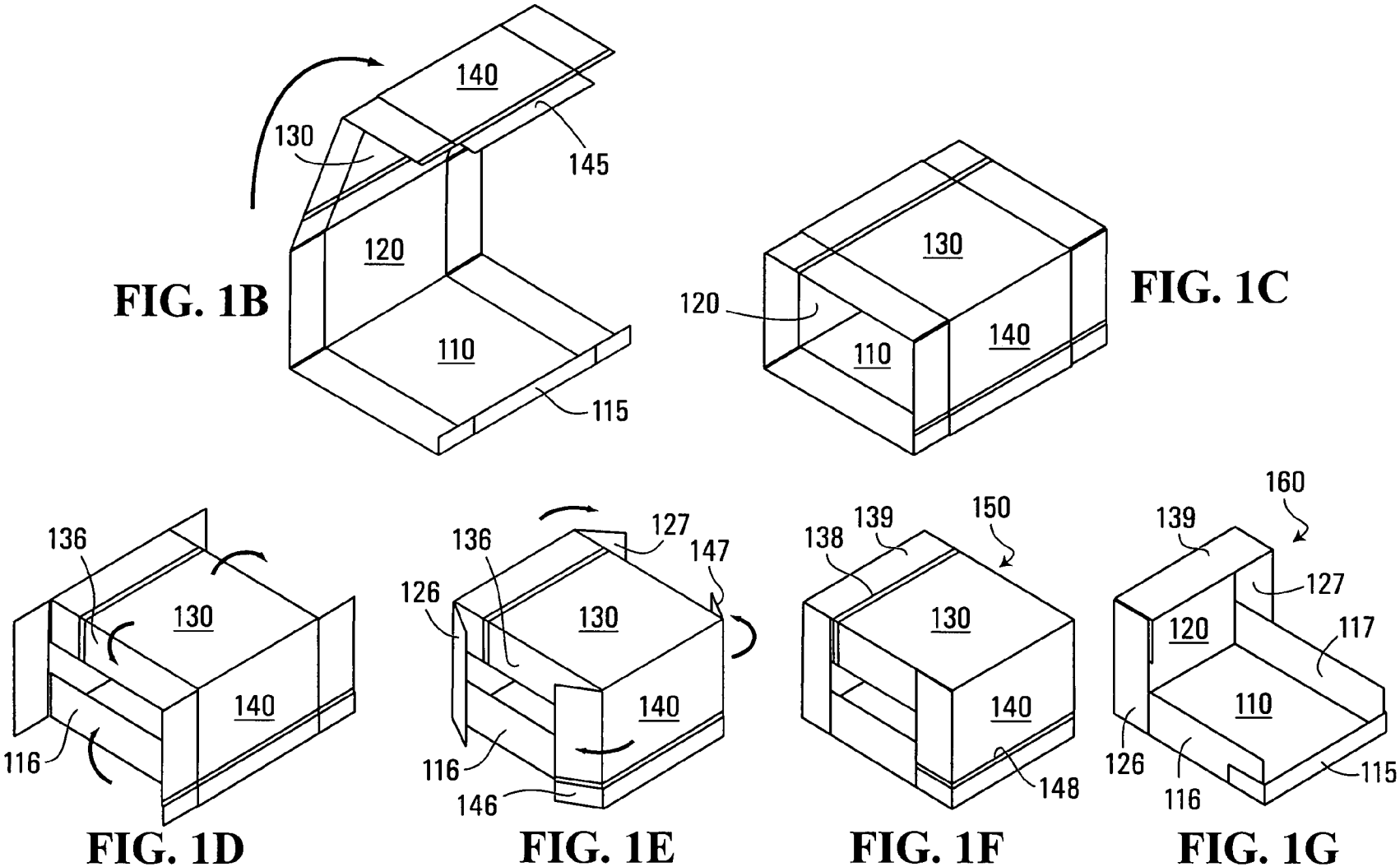
FIGS. 1B, 1C, 1D, 1E, and 1F are perspective views of the blank of FIG. 1, at different stages of being folded into a box, exemplary of an embodiment of the present invention.
FIG. 1G is a perspective view of a display box formed from the box of FIG. 1F by removing a portion thereof, exemplary of an embodiment of the present invention.

First, as shown in FIG. 1B, panels 110, 120, 130, 140 and end flaps 115, 145 are folded along the fold lines at the edges between them to form a tube shape as shown in FIG. 1C. End flaps 115 and 145 overlap and may be glued together, or otherwise attached to each other.

For example, a hot melt adhesive may be used and may be applied using, for example, a hot glue gun.

Next, side flaps 115, 116, 117, 118, 119, 126, 127, 136, 137, 145, 146, 147 are folded inwardly, as shown in FIGS. 1D and 1E, to form a partially open box 150, as shown in FIG. 1F. As depicted, side flaps 116, 136 may be folded first and then side flaps 126 and 146 are folded over side flaps 116, 136. However, the order in which the flaps are folded may be varied in different embodiments and does not have to be the same as shown in FIGS. 1D and 1E. For example, in a different embodiment, flaps 126, 146 may be folded before flaps 116, 136 are folded.

Box 150 has a bottom formed from bottom panel 110; a top formed from top panel 130; a back formed from back side panel 120; a front formed from front panel 140; a partially open left side formed from side flaps 116, 126, 136, 146; a partially open right side formed from side flaps 117, 127, 137, 147.

Side flaps 116, 126, 136, 146, 117, 127, 137, 147 are sized so that the right and left sides of box 150 are partially open. For example, as depicted, each side flap 116, 126, 136, 146, 117, 127, 137, 147 may have a width that is less than half of the width of the panel to which the side flap is attached. In a different embodiment, a different arrangement or configuration of side flaps may be used to form the partially open sides, as can be appreciated by those skilled in the art.

Side flaps 116, 126, 136, 146, 117, 127, 137, 147 may be shaped and sized so that each side flap partially overlaps with each adjacent side flap. The overlapped portions of the side flaps may be glued, stapled, taped, or otherwise attached or affixed together, to seal box 150.

The goods (not shown) to be packaged may be placed inside box 150 before both left and right sides of box 150 are sealed.

The partial openings on the left and right sides of box 150 may allow partial viewing of the goods, and may reduce the materials needed to form box 150. However, the openings should be shaped and sized to prevent the goods from falling out of box 150.

Box 150 with the contained goods may then be transported or stored. For example, box 150 with the contained goods may be conveniently placed on a storage or display shelf.

Box 150 may be opened by tearing off tear strips 138 and 148, thus separating a portion of each of top panel 130, side panel 140, and side flaps 136, 137, 146, 147 from the remainder of box 150 along the tear lines provided by tear strips 138 and 148. As can be understood, box 150 may be opened by tearing off tear strips 138 and 148 within a limited space, such as on a storage or display shelf. As tear strips 138 and 148 are located on the top or in the front of box 150, it is not necessary to remove any portion of box 150 at the back of box 150, which may be inconvenient to do when box 150 is placed on a shelf.

The remainder of box 150 forms a display box 160 with partially opened top and front, as shown in FIG. 1G. Therefore, the goods placed in box 150 become accessible and visible in box 160. It is not necessary to remove the goods from box 150 or 160 to place them on the shelf, to view them, or to access them. A user can conveniently remove the goods from the partially open box 160, either from the open front side or the open top.

As a relatively large portion of the top and front of box 150 can be conveniently removed, relatively large items may be stored in box 150 on a shelf and may be conveniently displayed and removed from display box 160.

The back panel 120 and top panel portion 139 and other remaining portions of side flaps can conveniently provide structural support for confining the goods on display. For example, back panel 120 can prevent the goods from falling off the shelf from the back side.

As now can be appreciated, to remove the desired portions of the panels and side flaps, tear lines need to be properly positioned in blank 100. For example, to avoid tearing off a portion of side flaps 126 and 127, tear strip 138 should be positioned away from end edge 131 by a distance that is substantially equal or greater than the width of side flaps 126 and 127, as depicted. In some embodiments, tear strip 138 may be distanced from edge 131 such that in box 150 the tear line provided by tear strip 138 is aligned with the free edge of each of side flaps 126 and 127. In some embodiments, when a smaller portion 139 is desired, tear strip 138 may be moved closer to edge 131, and the width of side flaps 126 and 127 may be correspondingly reduced. In any event, the tear strips are positioned so that when the tear strips are torn off, the desired portions of top panel 130, front side panel 140, and selected side flaps are each at least partially removed.

Further, as depicted, tear lines provided by tear strips 138 and 148 in blank 100 are substantially straight lines. Blanks with straight tear lines may be easier to design and produce. Further, the openings formed by removal of the removable portions along the tear lines may be conveniently adjusted when the tear lines are straight and are substantially parallel to the edges of top panel 130.

As tear strip 138 extends across top panel 130 between its side edges 132 and 134, and across side flaps 136 and 137, the top of box 150 may be conveniently opened by removing tear strip 138, without using any opening or cutting tools. A portion of each side flap 136, 137, 146, 147 is also conveniently removed when tear strips 138 and 148 are torn off.

As depicted, two openings may be formed in the sides of box 150 by the gaps between side flaps 116, 126, 136, 146, 117, 127, 137, 147. These openings may be conveniently utilized to handle the box, and to provide a viewing window for viewing the content in box 150 without opening it. Further, less material is needed as compared to a box with fully covered sides. Conveniently, the design of blank 100 allows the openings to be formed during assembly, without having to form openings in blank 100 during fabrication of the blank. The size and position of the openings may be conveniently adjusted by adjusting the sizes of one or more of side flaps 116, 126, 136, 146, 117, 127, 137, 147.

In different embodiments, side flaps 116, 126, 136, 146, 117, 127, 137, 147 may also be sized so that they cover the entire side of the box formed by these side flaps and no opening is left.

Further, as depicted, blank 100 as a whole is substantially rectangular. As such, it is easier to produce and waste of material is limited during production, as compared to production of blanks that have irregular shapes and varying widths along their lengths.

In an exemplary embodiment, blank 100 or other blanks described herein may be formed using various different types of known methods and systems for forming such blanks, appropriately adapted to form the features disclosed herein.

For example, the making of a blank 100 from a corrugated fibreboard material can start with making with first forming a sheet of corrugated material using a corrugator machine, such as one provided by BHS Corrugated Maschinen- and Anlagenbau GmbH™. The corrugator machine may produce a length of corrugated material of a given width that can be used immediately or stored in a roll until it is ready to be utilized.

The next step may involve utilizing a roll or sheet of such corrugated material that may have an approximate width that may be the same as the width of the desired blank that may be used to form the case. The roll or sheet can be also cut transversely such as to create sections of cardboard that are generally rectangular in shape. The corrugated material may then be fed through what is known as a flexo-folder gluer machine. In passing through such a machine, the corrugated sheet may pass through a printer, which prints words or pictures on one or both sides of the sheet. Next, the material may be creased both across and along the sheet material such that when the blank is folded/erected it may easily bend along the crease (fold) lines to form the desired shape.

The creased sheet may then be "slotted" with a slotting device which cuts thin transversely oriented "slots" in the board in intervals along a desired direction. These slots create the panels that may be folded. Finally, the sheet material may go through a rotary die cutter to remove excess corrugated material along one end of the board and crush down a portion along a fold line, to create a thin "hinge". The purpose of the hinge is to later allow the board to be doubled back on itself (i.e. glue one end of the board to the other to create a tube) and glued.

At some stage of this process, tear strips 138 and 148 may be formed in the blank such as by applying a device to create perforations in the blank. For example, a steel die may be pre-applied to a part of the blank to form the perforations.

The result up to this point can be a flat blank. Thereafter a flexo-folder gluer may apply glue to the hinge portion of the blank. The panels of the blank are then folded over by a folding mechanism such that one end of the blank is now glued to the other in a flattened tube-shaped orientation to create a flat tubular shaped blank such as is shown in FIG. 1C.

After the tubular shaped blank has been created, it may be grouped with other blanks and shipped to another location where the boxes are to be erected and packed.

When it is desired to fill a box with one or more products, a two step operation may be required. First, the box can be erected from its knock-down configuration, either by hand or using a "case erector" machine. Examples of commercially available case erectors include case packers made by iPak Machinery Ltd.™

The second step may be the placing of the products into the formed case, either by hand or using a "case packer" machine. Examples of commercial case packers include case packers made by iPak Machinery Ltd.™ of Canada. The box can then be sealed with the product inside.

It may also be possible to utilize blanks that have not been formed into tubular forms such as in FIG. 1C in a first step, but rather using flat blanks and a wrap around machine. An example of a commercial wrap around machine is available from CERMAX™ of France. The wrap around machine, utilizing a flat blank, may place one or more products on one panel such as panel 110 and then cause the remaining panels to be folded around and glued in the sequence identified in FIGS. 1A to 1F.

As can be understood, blank 100 may be modified without losing all of its benefits.

For example, in place of a tear strip, a tear line may be provided in another suitable form. A tear line may refer to any line or elongated portion in the blank that is configured or adapted to facilitate the removal of a portion of the blank. Tear lines may be provided in the form of tear-away or tear-out strips, pull strips, tear- or pull-away tabs, perforation lines such as punch-out perforation lines, score lines, thinned or weakened strips or sections, or the like.

Figure 2A:
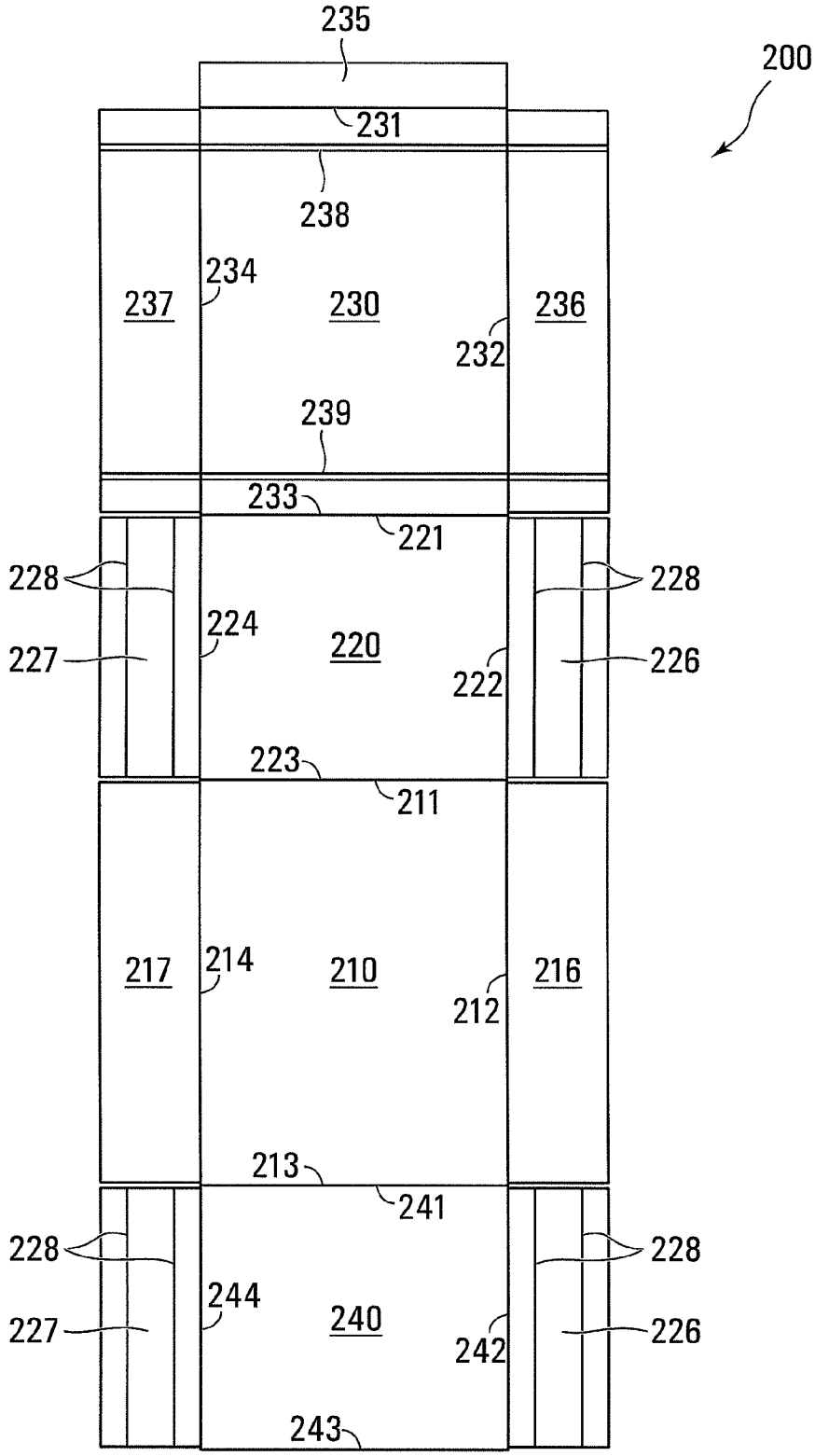
FIG. 2A is a plan view of another blank for a box, exemplary of an embodiment of the present invention.

FIG. 2A depicts a modified box blank 200, exemplary of another embodiment of the present invention.

Blank 200 includes serially attached bottom panel 210, side panel 220, top panel 230, and side panel 240.

Bottom panel 210 has end edge 211, side edge 212, end edge 213 and side edge 214. A fold line is provided at the joint of bottom panel 210 and side panel 220 along end edge 211. A side flap 216 is attached to bottom panel 210 along side edge 212, and a side flap 217 is attached to bottom panel 210 along side edge 214.

Side panel 220 has end edge 221, side edge 222, end edge 223 and side edge 224. A side flap 226 is attached to side panel 220 along side edge 222, and a side flap 227 is attached to side panel 220 along side edge 224.

Bottom panel 210 and side panel 220 are attached to each other along end edges 211 and 223.

Top panel 230 has end edge 231, side edge 232, end edge 233 and side edge 234. An end flap 235 is attached to end edge 231. A side flap 236 is attached to top panel 130 along side edge 232, and a side flap 237 is attached to top panel 230 along side edge 234. Two tear lines are provided by way of tear strips 238, 239 across top panel 230 and side flaps 236 and 237.

Side panel 240 has end edge 241, side edge 242, end edge 243 and side edge 244. A side flap 246 is attached to side panel 240 along side edge 242, and a side flap 247 is attached to side panel 240 along side edge 244.

Bottom panel 210 and side panel 240 are attached to each other along end edges 213 and 241.

A fold line is provided at the joint between each pair of attached panels 210, 220, 230, 240 and flaps 235, 216, 217, 218, 219, 226, 227, 236, 237, 246, 247, so that the panels and flaps are foldable along the fold lines to form a box.

Further, two substantially parallel fold lines 228 are provided on each of side flaps 226, 227, 246 and 247 attached to side panels 220 and 240 respectively. Fold lines 228 are also substantially parallel to side edges 222, 224 or 242, 244.

Blank 200 may be folded into a box 250, as illustrated in FIGS. 2B, 2C, 2D and 2E.

Figures 2B, 2C, 2D, 2E, 2F:
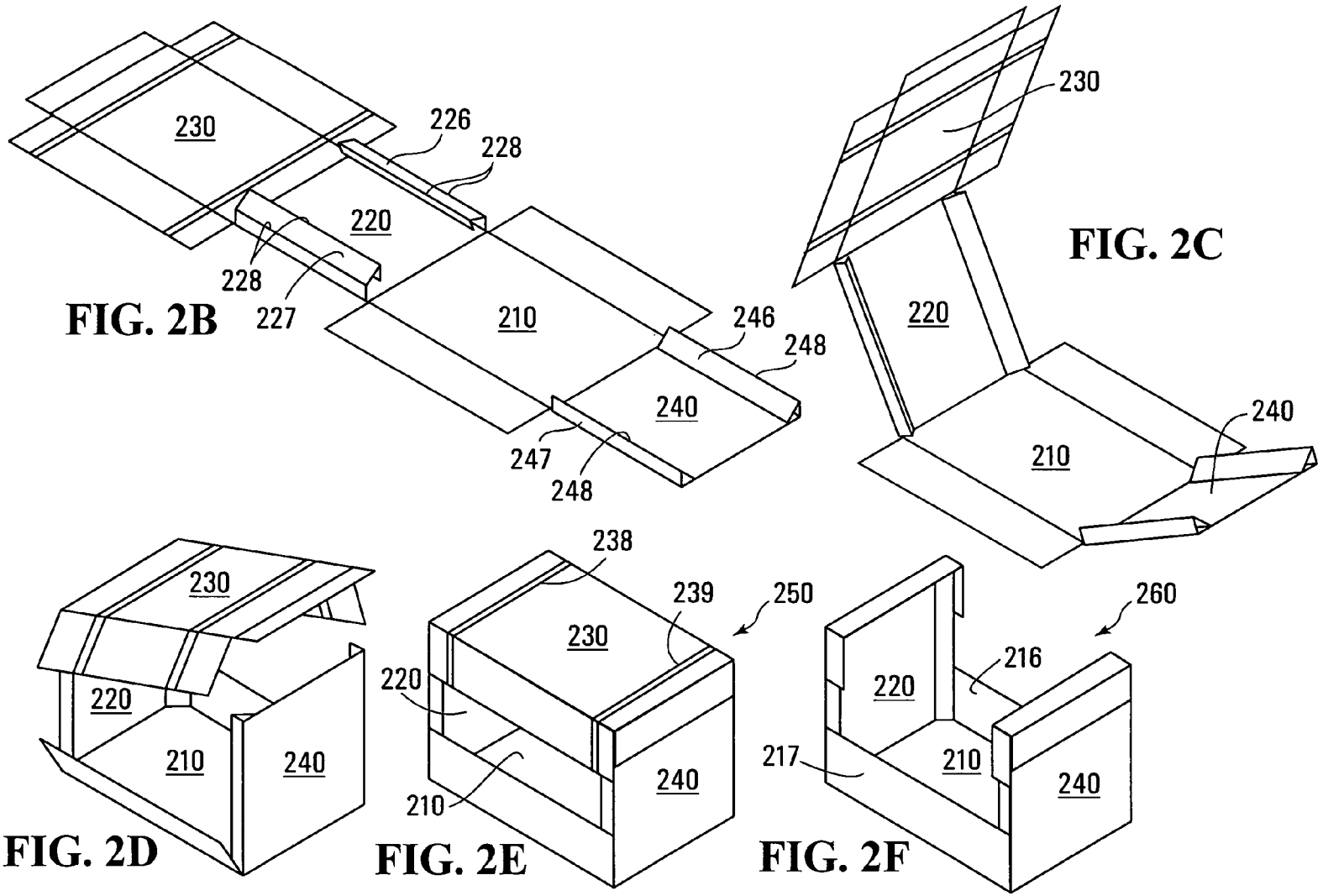
FIGS. 2B, 2C, 2D, and 2E are perspective views of the blank of FIG. 2A, being folded into a box, exemplary of an embodiment of the present invention.
FIG. 2F is a perspective view of a display box formed from the box of FIG. 2E by removing a portion thereof.

As shown in FIGS. 2B and 2C, side flaps 226, 227, 246 and 247 are each folded along fold lines 228 and side edge 222, 224, 242, or 244 to form a triangular prism shaped reinforced edge.

As shown in FIGS. 2C, 2D and 2E, panels 210, 220, 230, 240, end flap 235, and side flaps 216, 217, 236, 237 are next folded along the respective fold lines at the edges between them to form a box 250 with two partially open sides. The reinforced edges formed from side flaps 226, 227, 246 and 247 can provide a strengthened support frame for box 250. The overlapping portions may be glued or stapled together.

Box 250 has a bottom formed from bottom panel 210, a top formed from top panel 230, closed sides formed from side panels 220, 240, and partially open sides respectively formed from side flaps 216, 226, 236, and 246, or 217, 227, 237, and 247.

In this embodiment, tear strips 238, 239 may be distanced from edges 231, 233 so that tear strips 238, 239 are aligned or clear of the free edges of side flaps 226, 227 and 246, 247, respectively. Such alignment or clearance allows convenient removal of tear strips 238, 239 with the removable portions of top panel 230 and side flaps 236, 237.

The top 230 and the top parts of the partially opened sides of box 250 may be removed by tearing off tear strips 238 and 239, to form a display box 260, as shown in FIG. 2F. Display box 260 has a closed bottom (formed from panel 210), two closed sides (formed from panels 220 and 240), an open top, and two partially open sides (formed mainly by flaps 216 and 217). The four vertical edges of box 260 are reinforced with the folded flaps 226, 227, 246, 247.

The reinforced edges may have a substantially triangular prim shape as depicted in FIGS. 2B, 2C, 2D, and 2F. The triangular support edges may be vertically oriented during use to provide improved support, such as when boxes are stacked one on top of another. When the removable top portion is removed, the remaining reinforced edges may also provide improved support for the remaining side panels 220, 240.

In different embodiments, further tear-strip(s) (not shown) may be provided on blank 200, such as on panel 240 parallel to edge 241, or on flaps 216 and 217, so that front panel 240 may be conveniently removed, either partially or completely, during use.

In a different embodiment, the reinforced edges may be formed of double-folded flaps, as shown in FIGS. 3A, 3B, 3C, 3D, 3E, and 3F.

Figure 3A:
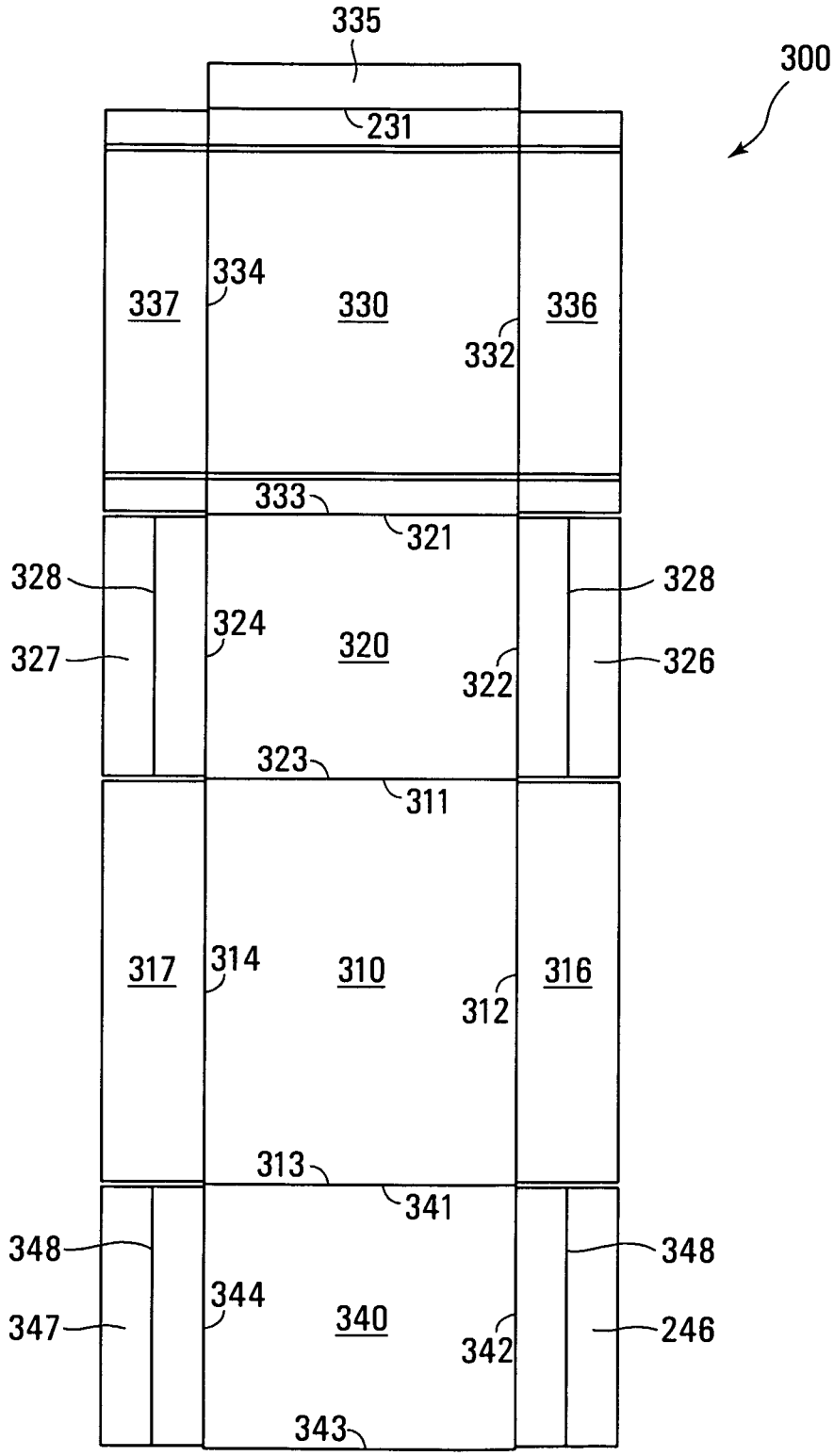
FIG. 3A is a plan view of a further blank for a box, exemplary of an embodiment of the present invention.
Figure 3C:
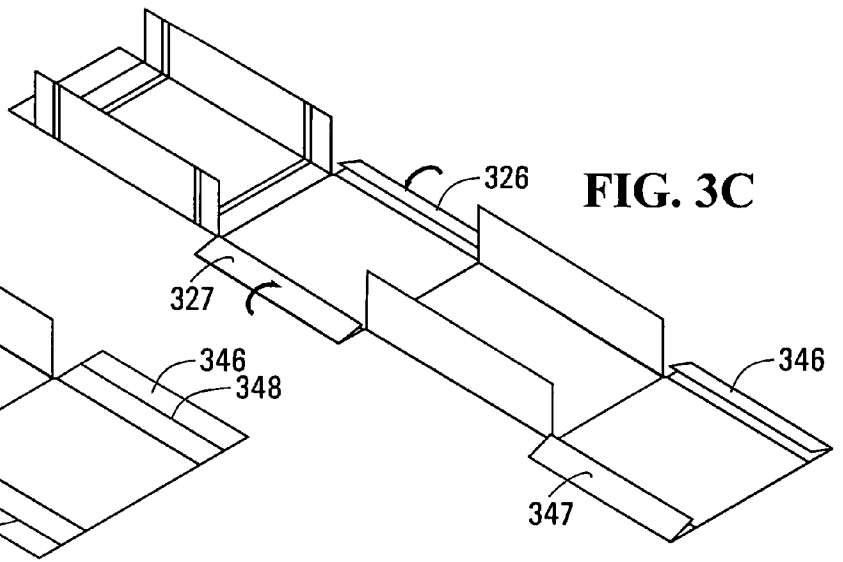
FIGS. 3B, 3C, 3D and 3E are perspective views of the blank of FIG. 3A, being folded into a box, exemplary of an embodiment of the present invention.
Figure 3B:
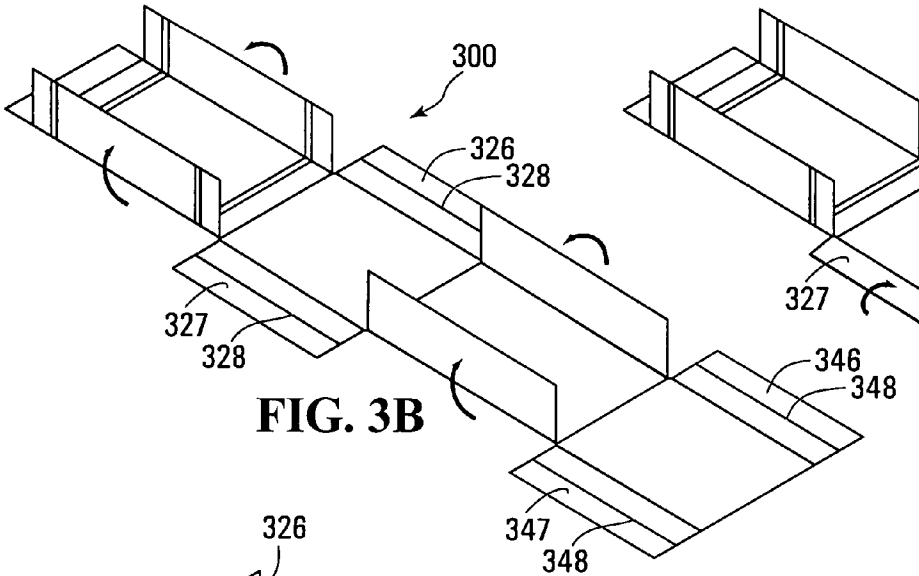
Figure 3F:
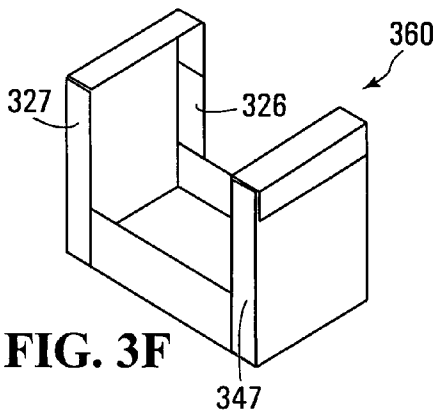
FIG. 3F is a perspective view of a display box formed from the box of FIG. 3E by removing a portion thereof.
Figure 3E:
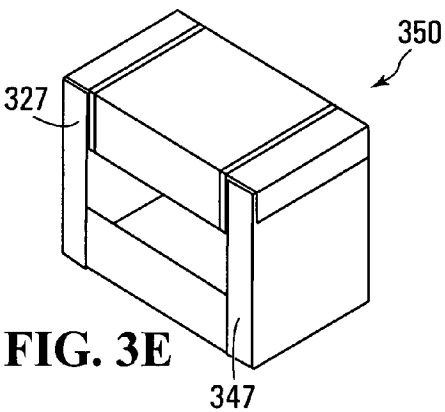
Figure 3D:
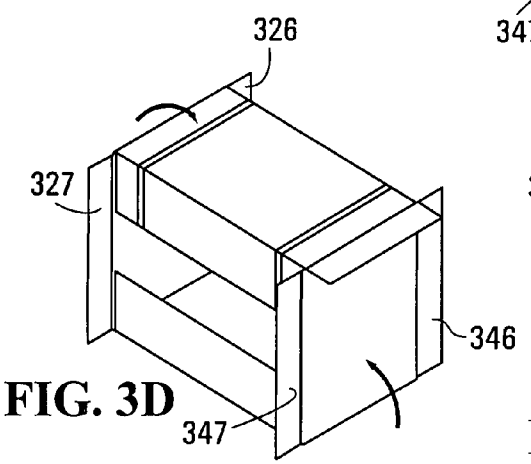

Blank 300 shown in FIG. 3A is similar to blank 200, except that flaps 326, 327, 346, 347 each has only one fold line 328 or 348. Blank 300 may be folded to form a box 350, and then transformed to display box 360, in a similar manner as for forming box 250 and display box 260 from blank 200, as illustrated in FIGS. 3B, 3C, 3D, 3E, and 3F. A difference is that flaps 326, 327, 346, 347 only need to be folded once to form double layer.

On the one hand, the edges reinforced by folded flaps 226, 227, 246, 247 may be stronger. On the other hand, the edges reinforced by folded flaps 326, 327, 346, 347 may provide sufficient strength in some applications, and blank 300 and box 350 may be easier to form as compared to blank 200 and box 250.

Figure 4A:
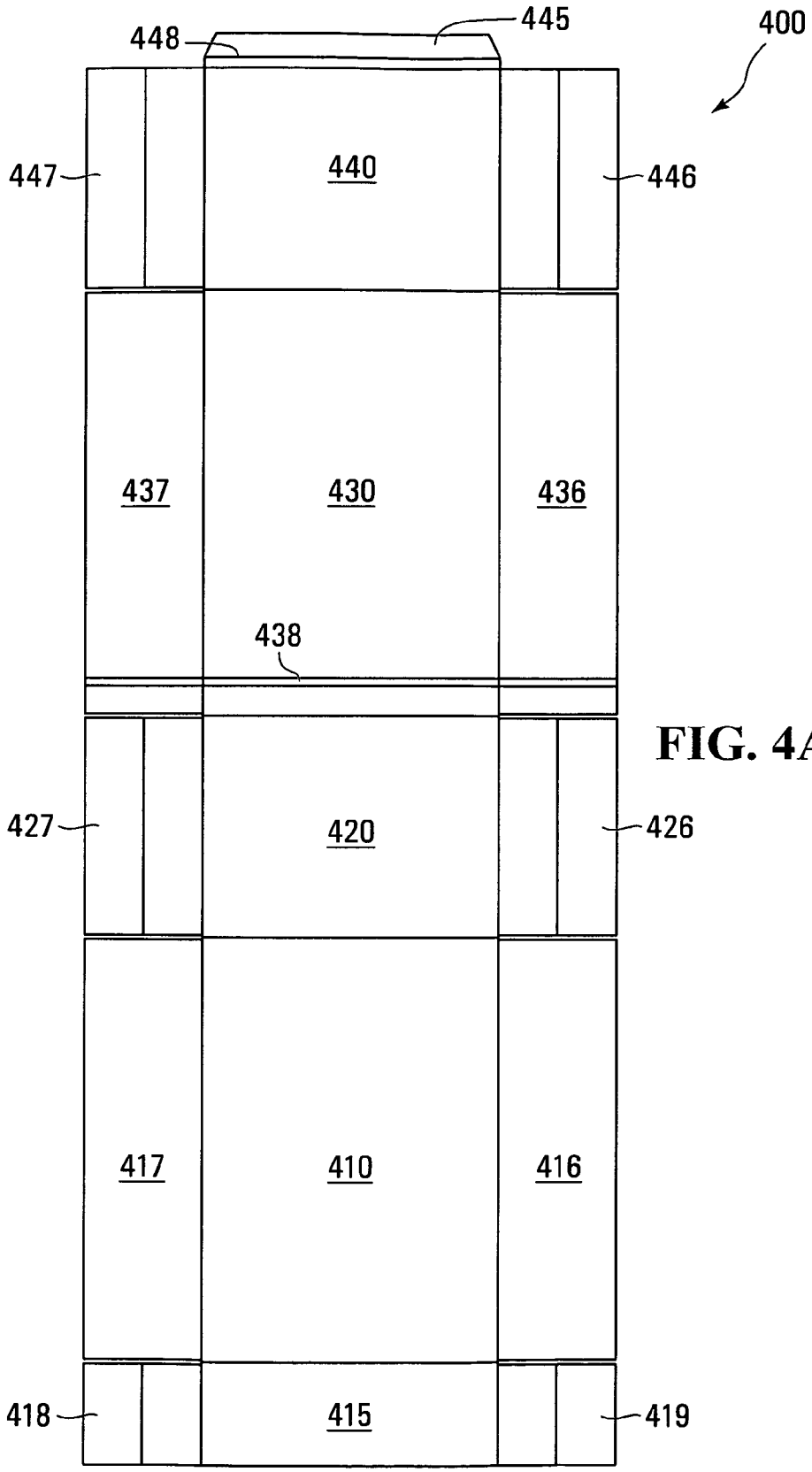
FIG. 4A is a plan view of another blank for a box, exemplary of an embodiment of the present invention.
Figure 4C:
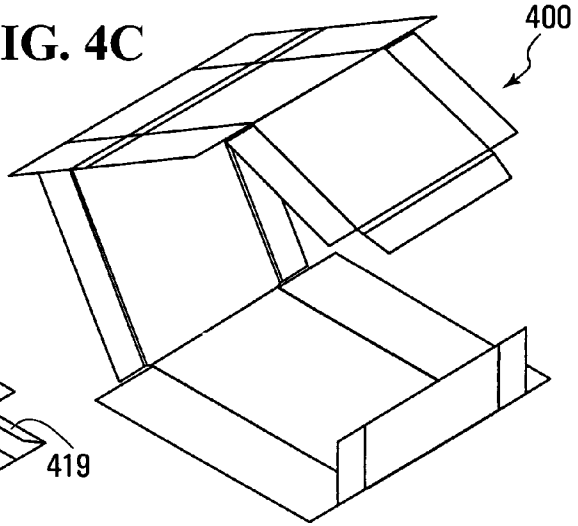
FIGS. 4B, 4C, 4D, and 4E are perspective views of the blank of FIG. 4A, being folded into a box, exemplary of an embodiment of the present invention.

FIG. 4A shows another blank 400, exemplary of an embodiment of the present invention. Blank 400 is similar to blank 100, but with the differences discussed below.

Specifically, blank 400 includes serially attached bottom panel 410, side panel 420, top panel 430, and side panel 440. An end flap 415 and two side flaps 416, 417 are attached to bottom panel 410. End flap 415 is also attached to two side flaps 418, 419. Two side flaps 426, 427 are attached to side panel 420. Two side flaps 436, 437 are attached to top panel 430. An end flap 445 and two side flaps 446, 447 are attached to side panel 440. Tear lines are provided by way of tear strip 438 on panel 430 and tear strip 448 on panel 440.

Blank 400 may be folded as shown in FIGS. 4B, 4C, 4D, and 4E, to form box 450.

As can be seen, a fold line is provided on each of side flaps 418, 419, 426, 427, 446, 447 so that each of these side flaps may be folded to form a double layer to provide a reinforced edge in box 450, as illustrated.

Figure 4B:
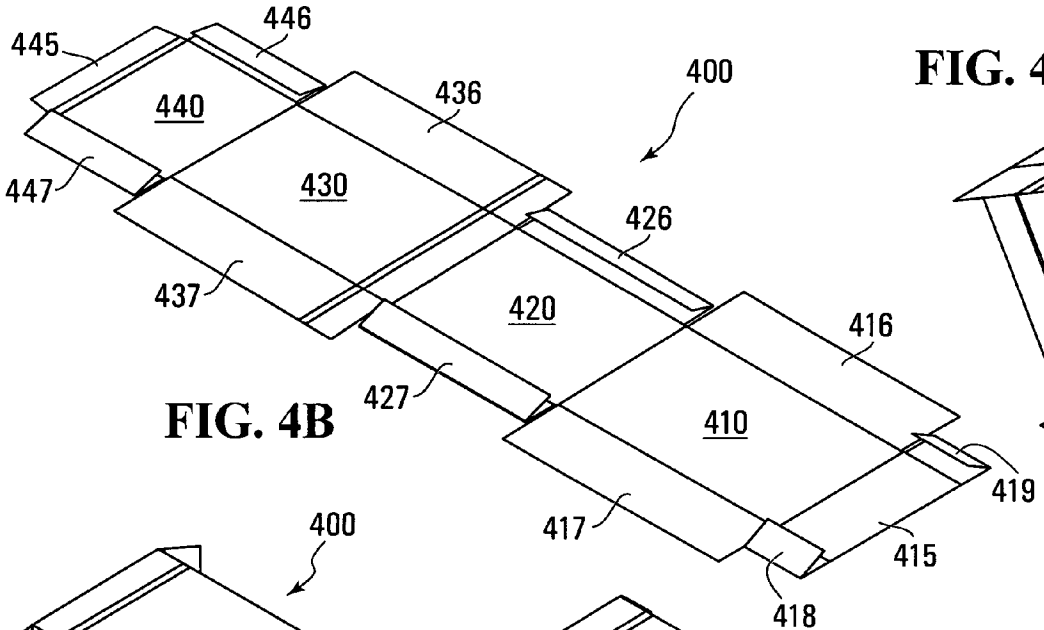
Figure 4F:
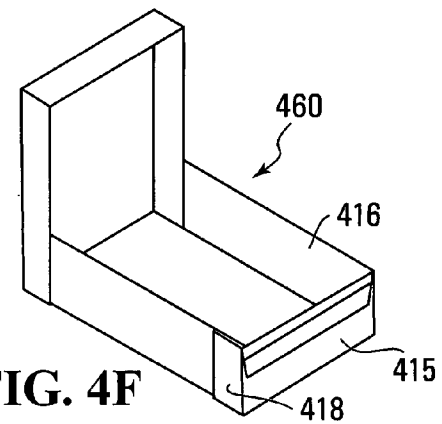
FIG. 4F is a perspective view of a display box formed from the box of FIG. 4E by removing a portion thereof.

Portions of the top and front of box 450 may be removed by tearing off tear strips 438 and 448, to form a display box 460 as shown in FIG. 4F. As depicted, in blank 400, the length of side flaps 418 and 419 are approximately equal to the width of side flaps 416 and 417; and tear strip 448 is aligned with the edges of side flaps 416, 417, 418 and 419 in box 450. As a result, after removal of tear strip 448, the top edges of the remaining sides formed by end flap 415 and side flaps 416, 417, 418 and 419 are substantially flush with each other.

As discussed above, a blank, such as blank 400, may be fully assembled on a case erector, following the procedure shown in FIGS. 4B to 4E.

Figure 4E:
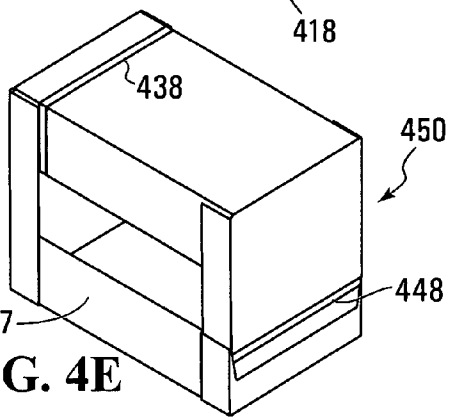
Figure 4D:
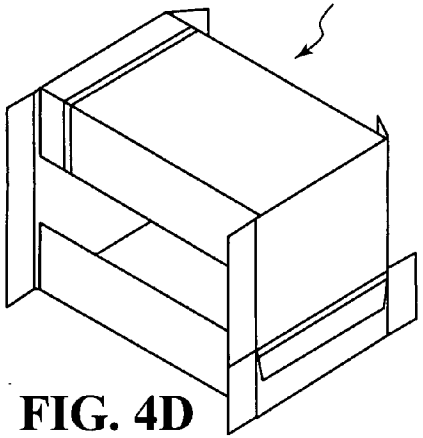
Figures 4G, 4H, 4I:
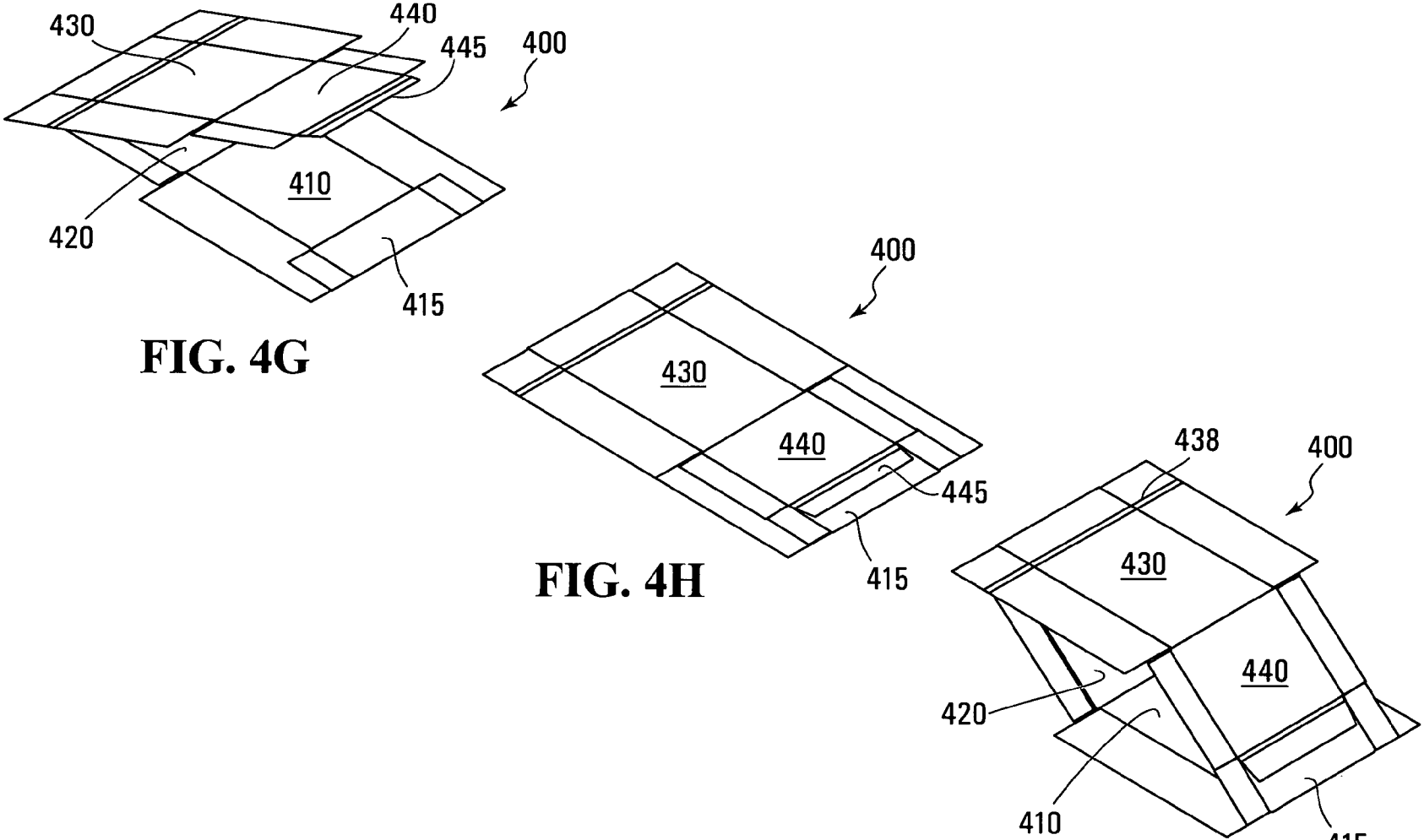
FIGS. 4G, 4H, and 4I are perspective views of the blank of FIG. 4A, being folded differently as shown in FIG. 4C.
Figure 5A:
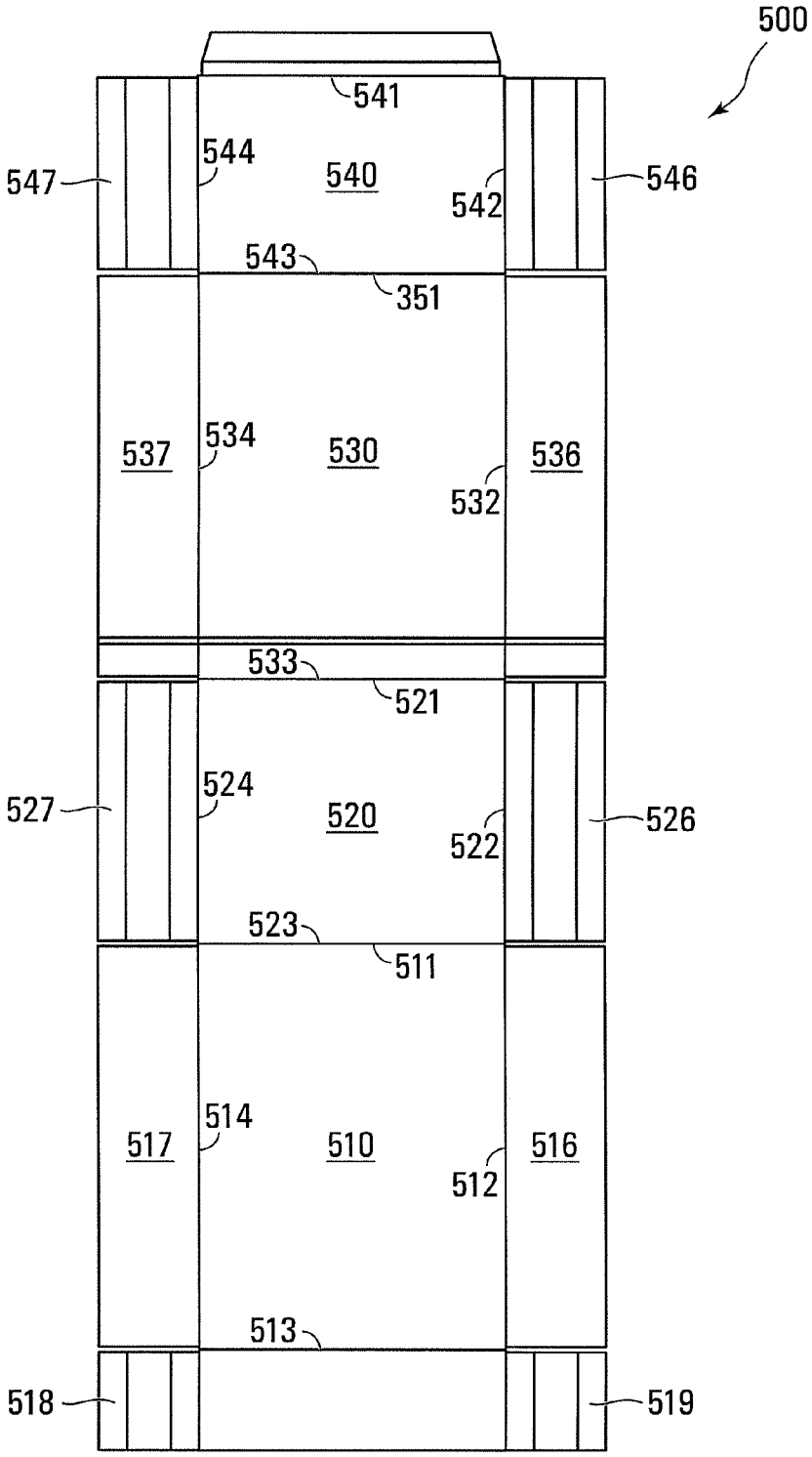
FIG. 5A is a plan view of another blank for a box, exemplary of an embodiment of the present invention.
Figure 5C:
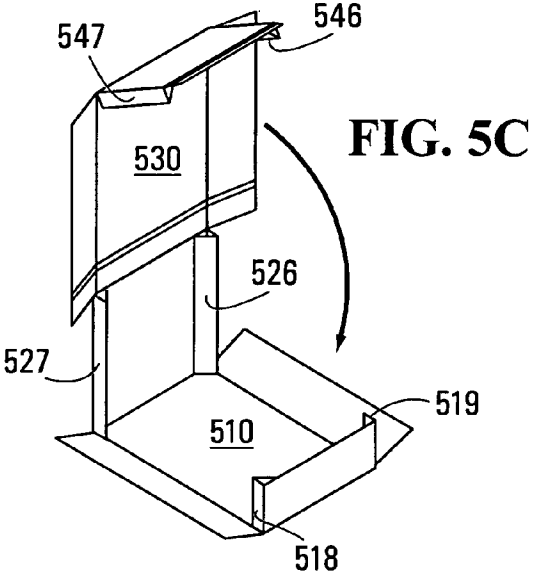
FIGS. 5B, 5C and 5D are perspective views of the blank of FIG. 5A, being folded into a box, exemplary of an embodiment of the present invention.
Figure 5B:
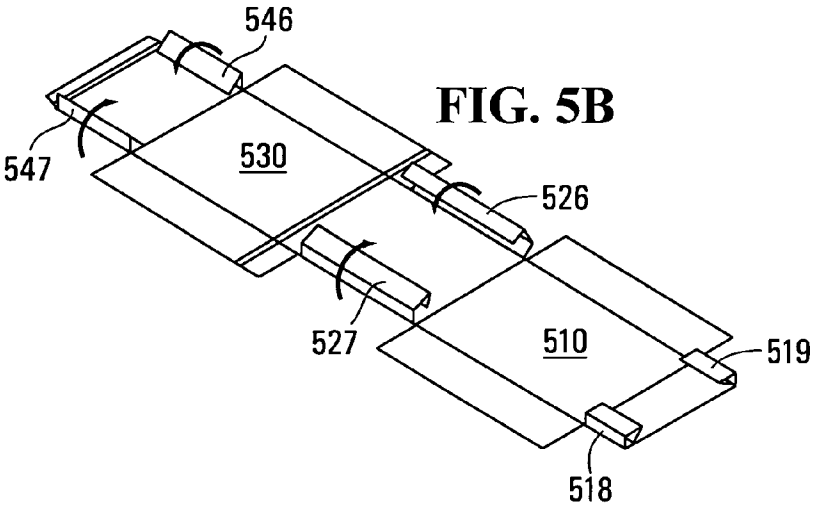
Figure 5E:
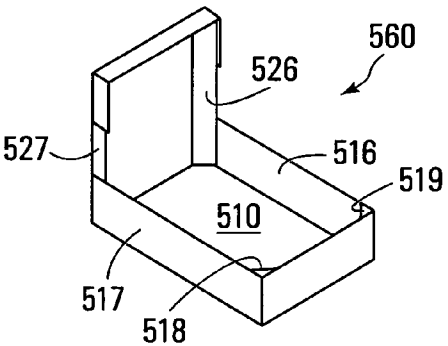
FIG. 5E is a perspective of a display box formed from the box of FIG. 5D by removing a portion thereof.
Figure 5D:
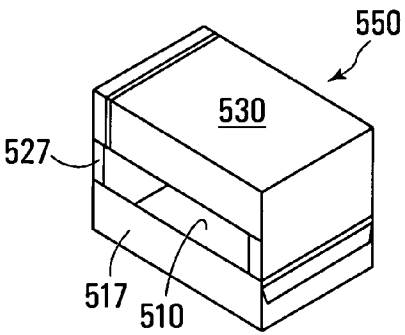

Alternatively, blank 400 may be partially pre-assembled such as shown in FIGS. 4B, 4G and 4H, before being assembled on a case erector such as shown in FIGS. 4I, 4D, and 4E, in that order. In particular, after folding side flaps 418, 419, 426, 427, 446, 447 as shown in FIG. 4B, panels 430 and 440 may be folded together along the edge between panels 420 and 430, towards panels 410 and 420, as shown in FIG. 4G. The partially assembled blank is flattened as depicted in FIG. 4H and is thus convenient to store and transport before being completely assembled. End flap 445 may be glued to end flap 415 during pre-assembly or at a later time.

FIGS. 5A, 5B, 5C, 5D, and 5E show a blank 500 for forming a box 550 and display box 560, which are similar to blank 400, box 450 and display box 460, except that the corner edges are reinforced with triangular prism shaped supports that are formed by side flaps 518, 519, 526, 527, 546, 547, folded along two fold lines, similar to the corner supports in box 250 formed from blank 200.

Conveniently, as illustrated above, a shipping and display container may be formed from a single blank according to exemplary embodiments of the present invention disclosed herein. Thus, the manufacture and assembly process may be simplified as compared to boxes or containers that are formed from multiple pieces of blanks. However, in different embodiments, additional components or attachments may be added to the blanks or assembled boxes, if desired.

As can be understood, the panels in the blank are typically substantially rectangular, as depicted in the drawings. The side and end flaps may also be substantially rectangular, as depicted in the drawings. However, in different embodiments, one or more of the flaps and panels may have a different shape. For example, some of the flaps may have a substantially trapezoidal shape or triangular shape. It is also possible that one of the flaps has a curved terminal edge.

One or more permanent openings may also be provided in one or more of the panels and flaps of the blanks for various purposes depending on the application.

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A box blank comprising:

a top panel, a bottom panel, a first side panel, and a second side panel, said panels serially attached to one another and each of said panels having two side edges;

a side flap attached to each side edge of each panel;

a first tear line extending across said top panel and the side flaps attached to said top panel; and a second tear line extending across said top panel and said side flaps attached to said top panel, or extending across said first side panel and the side flaps attached to said first side panel, wherein said panels and flaps are foldable to form a box comprising a bottom formed from said bottom panel, a top formed from said top panel, a first side formed from said first side panel, a second side formed from said second side panel, third and fourth sides each formed from a plurality of said side flaps each extending from one of said panels, wherein said side flaps are sized so that said third and fourth sides of said box are partially open, and wherein said first and second tear lines are positioned so that said top and said third and fourth sides of said box are each partially removable by separating them along said first and second tear lines, and after said separating, remaining portions of said third and fourth sides remain attached to a remaining portion of said top and at least a portion of said first side.

2. The blank of claim 1, wherein said first and second tear lines are substantially parallel.

3. The blank of claim 1, wherein two of said panels are end panels each having an end edge, said blank further comprising an end flap attached to said end edge of at least one of said end panels, said end flap foldable along said end edge.

4. The blank of claim 3, wherein said at least one of said end panels comprise two of said end panels.

5. The blank of claim 1, wherein said first tear line is substantially perpendicular to said side edges of said top panel and is positioned so that a portion of said first tear line is adjacent a terminal edge of the side flaps attached to said second side panel in said box.

6. The blank of claim 1, wherein a fold line is provided between each one of said panels and each one of said flaps attached to each other.

7. The blank of claim 6, wherein said first and second tear lines are substantially parallel to a fold line between said top panel and one of said side panels adjacent to said top panel.

8. The blank of claim 1, wherein a fold line is provided on each one of said side flaps attached to one of said side panels, such that said each side flap is foldable along said fold line on said each side flap to form a reinforced edge in said box.

9. The blank of claim 8, wherein two fold lines are provided on said each side flap, such that said each side flap is foldable to form a triangular prism shaped reinforced edge in said box.

10. The blank of claim 1, wherein at least one of said first and second tear line is substantially straight.

11. The blank of claim 1, comprising a material selected from cardboard, paper, and plastic.

12. The blank of claim 1, wherein at least one of said first and second tear lines is provided by a line of perforation, or a tear strip.

13. The blank of claim 1, wherein said blank has a substantially rectangular shape.

14. A box comprising:

a bottom;

a top;

first and second sides opposite one another;

third and fourth sides opposite one another, each being partially open and comprising a top flap and a bottom flap separated from said top flap, said top flap attached to said top of said box;

a first tear line extending across said top and said top flaps; and a second tear line extending across said top and said top flaps, or extending across said first side;

wherein said first and second tear lines are positioned so that said top and said top flaps are each partially removable by separating them along said first and second tear lines, and after said separating, remaining portions of said third and fourth sides remain attached to a remaining portion of said top and at least a portion of said first side, and wherein said top, said bottom, and said sides are formed from a single box blank.

15. The box of claim 14, wherein said first and second tear lines are substantially parallel.

16. The box of claim 14, wherein said first and second tear lines are substantially parallel to an edge between said top and one of said first and second sides.

17. The box of claim 14, wherein at least one edge between two adjacent ones of said sides is reinforced.

18. The box of claim 17, wherein said at least one edge comprises a folded flap.

19. The box of claim 18, wherein said folded flap is folded along one fold line to form a double-layered support.

20. The box of claim 18, wherein said folded flap is folded along two parallel fold lines to form a substantially triangular prism support.

21. The box of claim 14, wherein at least one of said first and second tear lines is provided by a line of perforation or a tear strip.

22. The box of claim 14, wherein said first and second sides are closed sides.

23. The box of claim 14, wherein said box blank comprises a top panel, a bottom panel, a first side panel, and a second side panel, said panels serially attached to one another and each of said panels having two side edges; a side flap attached to each side edge of each panel; the first tear line extending across said top panel and the side flaps attached to said top panel; and the second tear line extending across said top panel and said side flaps attached to said top panel, or extending across said first side panel and the side flaps attached to said first side panel, wherein said panels and flaps are folded to form said box.

24. A display box comprising the box of claim 14, wherein the top and the top flaps have each been partially removed.

* * * * *